US011305143B2

(12) United States Patent
Libal

(10) Patent No.: US 11,305,143 B2
(45) **Date of Patent: *Apr. 19, 2022**

(54) FIRE EXTINGUISHING COMPOSITIONS AND METHOD

(71) Applicant: Tyco Fire Products LP, Lansdale, PA (US)

(72) Inventor: John Paul Libal, Peshtigo, WI (US)

(73) Assignee: Tyco Fire Products LP, Lansdale, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/097,229

(22) Filed: Nov. 13, 2020

(65) Prior Publication Data

US 2021/0154512 A1 May 27, 2021

Related U.S. Application Data

(63) Continuation of application No. 16/388,468, filed on Apr. 18, 2019, now Pat. No. 10,870,030, which is a continuation of application No. 15/301,627, filed as application No. PCT/US2015/024010 on Apr. 2, 2015, now Pat. No. 10,335,624.

(Continued)

(51) Int. Cl.
*A62D 1/02* (2006.01)
*A62D 1/00* (2006.01)

(52) U.S. Cl.
CPC ..... *A62D 1/0071* (2013.01); *A62D 1/005* (2013.01)

(58) Field of Classification Search
CPC ..... A62D 1/0071; A62D 1/005
See application file for complete search history.

(56) References Cited

U.S. PATENT DOCUMENTS 3,047,619 A 7/1962 Brace
3,257,407 A 6/1966 Brace
(Continued)

FOREIGN PATENT DOCUMENTS

CN 1539532 A 10/2004
WO WO-93/02788 A1 2/1993
(Continued)

OTHER PUBLICATIONS

English Translation of Abstract for Chinese Publication No. 102240431A, published Nov. 16, 2011, 1 page.
(Continued)

*Primary Examiner* — Andrew J. Oyer
(74) *Attorney, Agent, or Firm* — Foley & Lardner LLP

(57) ABSTRACT

A firefighting foam preservative composition and a method of making the firefighting foam preservative composition are provided. The firefighting foam preservative composition includes a suspension system containing water and at least one suspension agent. The firefighting foam preservative composition also includes a first polysaccharide that is soluble in the suspension system; and a second polysaccharide that is insoluble in the suspension system, but soluble in water alone. Methods of using the firefighting foam preservative composition to produce a firefighting foam and using the firefighting foam to secure a hazard by extinguishing fire and/or suppressing flammable vapors are also provided.

36 Claims, 4 Drawing Sheets

Related U.S. Application Data

(60) Provisional application No. 61/974,158, filed on Apr. 2, 2014.

(56) References Cited

U.S. PATENT DOCUMENTS 3,258,423 A 6/1966 Tuve et al.
3,422,011 A 1/1969 Jackovitz et al.
3,457,172 A 7/1969 Stewart et al.
3,562,156 A 2/1971 Francen
3,579,446 A 5/1971 Kroke et al.
3,621,059 A 11/1971 Bartlett
3,655,555 A 4/1972 Rossmy et al.
3,661,776 A 5/1972 Fletcher et al.
3,677,347 A 7/1972 Rosen et al.
3,759,981 A 9/1973 Hager et al.
3,772,199 A 11/1973 Tamai et al.
3,789,265 A 1/1974 Holz et al.
3,828,085 A 8/1974 Price et al.
3,839,425 A 10/1974 Bartlett et al.
3,849,315 A 11/1974 Chiesa, Jr.
3,941,708 A 3/1976 Gentit et al.
3,952,075 A 4/1976 Nakamura et al.
3,957,657 A 5/1976 Chiesa, Jr.
3,957,658 A 5/1976 Chiesa et al.
3,963,776 A 6/1976 Middleton
4,038,198 A 7/1977 Wagner et al.
4,042,522 A 8/1977 Falk
4,049,556 A 9/1977 Tujimoto et al.
4,060,132 A 11/1977 Chiesa, Jr.
4,060,489 A 11/1977 Chiesa, Jr.
4,069,158 A 1/1978 Bertocchio et al.
4,090,976 A 5/1978 Dehollander et al.
4,099,574 A 7/1978 Cooper et al.
4,149,599 A 4/1979 Chiesa, Jr.
4,203,850 A 5/1980 Wirtz et al.
4,209,407 A 6/1980 Schuierer et al.
4,306,979 A 12/1981 Tsuji
4,387,032 A 6/1983 Chiesa, Jr.
4,420,434 A 12/1983 Falk
4,424,133 A 1/1984 Mulligan
4,464,267 A 8/1984 Chiesa et al.
4,536,298 A 8/1985 Kamei et al.
4,999,119 A 3/1991 Norman et al.
5,207,932 A 5/1993 Norman et al.
5,218,021 A 6/1993 Clark et al.
5,225,095 A 7/1993 Dimaio et al.
5,296,164 A 3/1994 Thach et al.
5,391,721 A 2/1995 Hanen et al.
5,434,192 A 7/1995 Thach et al.
5,496,475 A 3/1996 Jho et al.
5,616,273 A 4/1997 Clark et al.
5,688,884 A 11/1997 Baker et al.
5,706,895 A 1/1998 Sydansk
5,750,043 A 5/1998 Clark
5,820,776 A 10/1998 Hansen et al.
5,882,541 A 3/1999 Achtmann
6,156,222 A 12/2000 Jennings et al.
6,231,778 B1 5/2001 Hansen
6,262,128 B1 7/2001 Stern et al.
6,365,676 B1 4/2002 Jennings et al.
7,005,082 B2 2/2006 Clark
7,011,763 B2 3/2006 Clark
7,135,125 B2 11/2006 Clark
7,172,709 B2 2/2007 Clark
7,569,155 B2 8/2009 Schaefer
7,588,645 B2 9/2009 Griese et al.
7,868,167 B2 1/2011 Harding et al.
7,994,111 B2 8/2011 Caggioni et al.
8,043,999 B2 10/2011 Sullivan et al.
8,207,094 B2 6/2012 Hutchins et al.
8,298,436 B2 10/2012 Michael
8,431,036 B2 4/2013 Mulligan et al.
8,524,104 B1 9/2013 Michael
8,946,486 B2 2/2015 Martin
9,089,730 B2 7/2015 Shalev et al.
9,259,602 B2 2/2016 Robinet et al.
9,420,784 B2 8/2016 Vanlaer et al.
9,446,272 B2 9/2016 Blunk et al.
9,669,246 B2 6/2017 Bowen et al.
9,675,828 B1 6/2017 Sery
9,687,686 B2 6/2017 Blunk et al.
9,919,175 B2 3/2018 Shalev et al.
9,950,978 B2 4/2018 Martin
9,956,447 B2 5/2018 Martin et al.
9,956,448 B2 5/2018 Martin
10,046,191 B1 8/2018 Hernandez et al.
10,071,273 B2 9/2018 Hansen et al.
10,173,089 B2 1/2019 Xie
10,328,297 B2 6/2019 Bowen et al.
10,369,394 B2 8/2019 Bowen
10,369,395 B2 8/2019 Bowen et al.
2007/0256836 A1 11/2007 Welton et al.
2011/0097294 A1 4/2011 Anthony et al.
2011/0240309 A1 10/2011 Kingma et al.
2012/0118590 A1* 5/2012 Mathis ..... A62D 1/0014 169/46
2013/0277597 A1 10/2013 Bowen et al.
2014/0275305 A1 9/2014 Svenson et al.
2016/0023032 A1 1/2016 Bowen
2016/0030790 A1 2/2016 Libal et al.
2016/0030793 A1 2/2016 Xie
2016/0038778 A1 2/2016 Siem
2016/0038779 A1 2/2016 Bowen et al.
2016/0166867 A1 6/2016 Hansen et al.
2017/0182341 A1 6/2017 Libal
2017/0259100 A1 9/2017 Bowen et al.
2018/0345061 A1 12/2018 Hernandez et al.

FOREIGN PATENT DOCUMENTS

WO WO-00/35536 A1 6/2000
WO WO-2012/045080 A1 4/2012
WO WO-2017/161156 A1 9/2017
WO WO-2017/161162 A1 9/2017
WO WO-2018/022763 A1 2/2018

OTHER PUBLICATIONS

English Translation of Abstract for Chinese Publication No. 106075792A, published Nov. 9, 2016, 1 page.

* cited by examiner

FIRE EXTINGUISHING COMPOSITIONS AND METHOD

REFERENCE TO EARLIER FILED APPLICATIONS

This application is a continuation of U.S. application Ser. No. 16/388,468, filed Apr. 18, 2019, which is a continuation of U.S. application Ser. No. 15/301,627, filed Oct. 3, 2016, which is a U.S. national stage of international patent application No. PCT/US2015/024010, filed Apr. 2, 2015, which claims the benefit under 35 U.S.C. § 119(e) of U.S. Provisional Patent Application No. 61/974,158, filed Apr. 2, 2014, which are incorporated herein, in their entirety, by this reference.

BACKGROUND

Foam materials are a class of commercial and industrial chemical-based materials. Foams can be prepared by aerating a foam composition, which can be derived by diluting a concentrated precursor composition. Depending on their application, foams require certain physical properties. Foam stability is one example of these physical properties.

Generally, foam stability refers to the ability of a foam to be used over an extended period of time. Individual components of a foam composition contribute toward different physical and chemical properties of both pre-foam mixtures and the final foam compositions. For example, certain surfactants can provide low surface tension and increased foamability. Further, the use of particular solvents can promote surfactant solubility and increased life span of the foam concentrate.

Foam stability is particularly preferable and important in firefighting applications, including fire prevention and fire extinguishment. Firefighting foams can be used in many different ways. High-expansion foams can be used when enclosed spaces must be quickly filled. Low-expansion foams can be used on burning spills. Generally, firefighting foams can be utilized in numerous locations, including inside of buildings, outside of buildings, underground, and in ships or other marine-related fires.

Unfortunately, foam stability has been a problem in firefighting applications. Particularly, the liquid that makes up firefighting foam slowly drains away from the foam. When a large amount of this liquid has drained from the bubble, the foam becomes fragile and ineffective at vapor suppression.

Previously, foam life has been extended by increasing the viscosity of the foam solution. This has been done by adding polysaccharides that impart a higher thixotropic viscosity to the foam solutions than previously attained. Polysaccharides have the added benefit of making the foam resistant to polar solvents such as alcohols and ketones. However, there is a limit to the quantity of polysaccharide a foam concentrate can contain and remain fluid. There is a threshold level of polysaccharide that above which the foam will become a semisolid or gel. Above this threshold, traditional methods of mixing the foam concentrate fail. Therefore, the length of time the life of the foam is extended is limited by the amount of polysaccharide that can be added to a foam concentrate.

Therefore, it is an object of the present invention to provide a firefighting extinguishing composition that increases the amount of polysaccharide that can be added to the foam concentrate, thereby extending the durability of firefighting foams and increasing the stability of the foam.

SUMMARY

The present disclosure relates generally to compositions for extinguishing fires. More particularly, the present disclosure relates to polysaccharide compositions that are capable of preserving and forming foams to extinguish fires and suppress flammable vapors. Compositions and methods of use of the compositions to increase the robustness and longevity of a firefighting extinguishing composition are disclosed.

In one aspect, a firefighting foam preservative composition includes: a suspension comprising water and at least one suspension agent; a first polysaccharide that is soluble in the suspension system; and a second polysaccharide that is insoluble in the suspension system but soluble in water alone.

In another aspect, a firefighting extinguishing composition includes: a suspension system comprising water and at least one suspension agent; a first polysaccharide that is soluble in the suspension system; a second polysaccharide that is insoluble in the suspension system; and at least one diluting agent that dissolves the second polysaccharide.

In another aspect, a method of preserving a firefighting foam composition includes: mixing water, a suspension agent, a first polysaccharide, and a second polysaccharide to form a suspension, wherein the first polysaccharide is soluble in the suspension and the second polysaccharide is substantially insoluble in the suspension.

DETAILED DESCRIPTION

Figure 1:
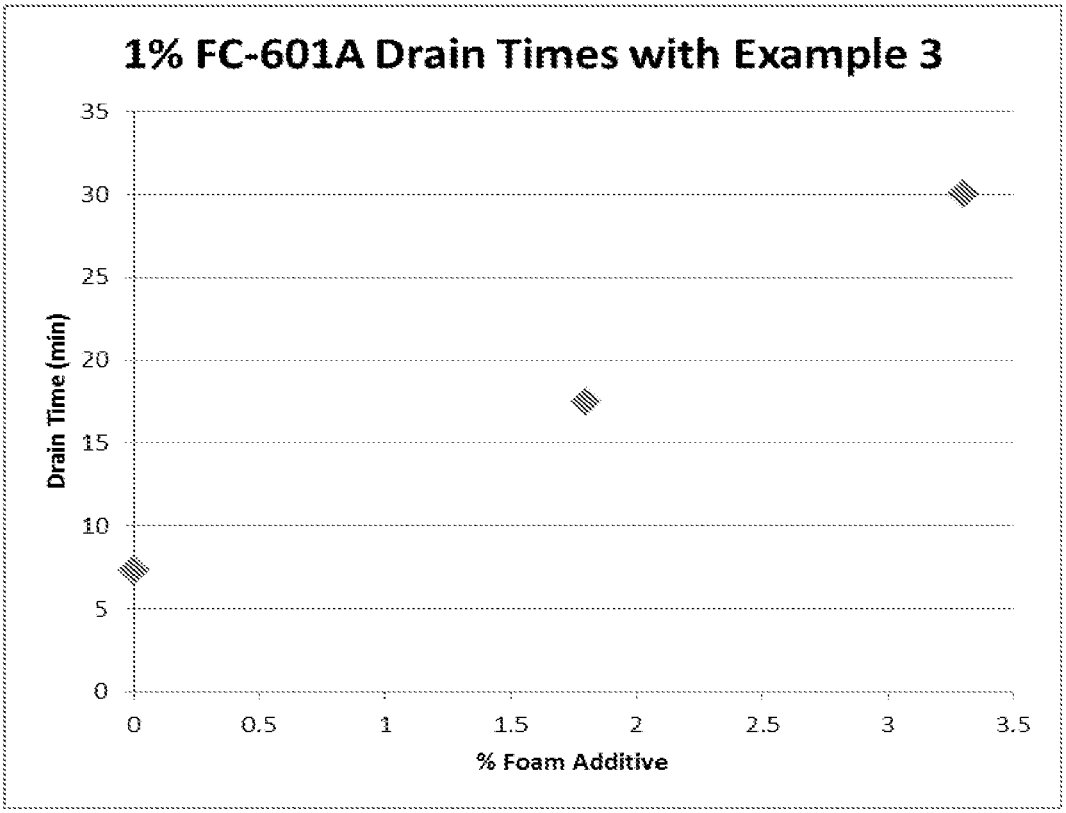
FIG. 1 is a graph illustrating changes in drain time (minutes) with varying % foam additive when utilizing 1% FC-601A with Example 3.

Compositions and methods of use of the compositions to increase the robustness and longevity of a firefighting extinguishing composition are disclosed. The firefighting extinguishing composition contains significantly higher concentrations of polysaccharide(s) than conventionally practiced while maintaining the concentrate in a liquid state. Higher polysaccharide content in the disclosed composition permits the preparation and use of foam solutions having higher viscosity. Among the benefits of such compositions, the higher viscosity slows the rate at which liquid drains from the foam. It also increases the thickness of the bubble wall. These two properties not only increase the longevity of the foam, but also make it more robust and resistant to damage and conditions in firefighting applications.

In one aspect, a firefighting extinguishing composition includes a suspension system comprising water and at least one suspension agent. The firefighting extinguishing composition also includes a first polysaccharide that is soluble in the suspension system, also known as the soluble polysaccharide. The firefighting extinguishing composition also includes a second polysaccharide that is insoluble in the suspension system but soluble in water alone, also known as the insoluble polysaccharide. In one embodiment, the insoluble polysaccharide is either insoluble or substantially insoluble in the suspension system but also soluble in water alone. Solubility, as known to one of ordinary skill, is the property of a substance, such as a polysaccharide, to dissolve in a suspension or suspension system. A polysaccharide that is "substantially insoluble" in the suspension means having a low solubility in the suspension system. In one embodiment, "substantially insoluble" means the polysaccharide has a solubility in the suspension at 25° C. of less than 1 g/L.

Binary Suspension Systems

As mentioned above, compositions disclosed herein include suspension systems. In one embodiment, the suspension system is a binary suspension system that includes water and a suspension agent. In some embodiments, the suspension agent is soluble in water, for example acetone, methanol, or ethanol. The suspension agent may be selected based on flammability, toxicity, cost, and environmental friendliness. In one embodiment, the suspension agent is selected from the group consisting of an organic solvent, a water-soluble polymer, and a salt.

Water-soluble polymers are defined as polymers that are soluble in water. In one embodiment, the water-soluble polymer is selected from the group consisting of polyethylene glycol, polyacrylic acid, polyethyleneimine, polyvinyl alcohol, polyacrylamides, carboxyvinyl polymers, poly(vinylpyrrolidinone) (PVP) and copolymers, and polyoxypropylene.

In one embodiment, the water-soluble polymer is polyethylene glycol (PEG). Different molecular weights of polyethylene glycol may be utilized including, but not limited to, a range of about 200 MW to about 10,000 MW. In some embodiments, the water-soluble polymer is selected from the group consisting of PEG 200 MW, PEG 400 MW, PEG 500 MW, PEG 1,000 MW, PEG 2,000 MW, PEG 5,000 MW, and PEG 10,000 MW. In some embodiments, the water-soluble polymer is selected from the group consisting of PEG 200 MW, PEG 400 MW, PEG 500 MW, and PEG 1,000 MW. In one embodiment, the water-soluble polymer is PEG 200 MW. In one embodiment, the water-soluble polymer is PEG 400 MW. In one embodiment, the water-soluble polymer is PEG 500 MW. In one embodiment, the water-soluble polymer is PEG 1,000 MW. In one embodiment, the water-soluble polymer is 2,000 MW. In one embodiment, the water-soluble polymer is PEG 5,000 MW. In one embodiment, the water-soluble polymer is PEG 10,000 MW.

In one embodiment, the salt is a metallic salt. In one embodiment, the salt is a metallic salt comprising a cation and an anion. In one embodiment, the cation of the metallic salt is selected from the group consisting of aluminum, sodium, potassium, calcium, copper, iron, magnesium, potassium, and calcium. In one embodiment, the cation is ammonium.

In one embodiment, the organic solvent is selected from the group consisting of diethylene glycol n-butyl ether, dipropylene glycol n-propyl ether, hexylene glycol, ethylene glycol, dipropylene glycol, tripropylene glycol, dipropylene glycol monobutyl ether, dipropylene glycol monomethyl ether, ethylene glycol monobutyl ether, tripropylene glycol methyl ether, dipropylene glycol monopropyl ether, propylene glycol, glycerol, and other glycols or glycol ethers. In one embodiment, the organic solvent is selected from the group consisting of glycols and glycol ethers. In one embodiment, the organic solvent is a glycol. In one embodiment, the organic solvent is a glycol ether. In one embodiment, the suspension agent has a flashpoint below a certain threshold.

In one embodiment, the ratio of water to suspension agent is from about 6:4 to 2:8. In one embodiment, the ratio of water to suspension agent is from about 6 to about 4. In one embodiment, the ratio of water to suspension agent is from about 5 to about 5. In one embodiment, the ratio of water to suspension agent is from about 4 to about 6. In one embodiment, the ratio of water to suspension agent is from about 3 to about 7. In one embodiment, the ratio of water to suspension agent is from about 2 to about 8.

Tertiary Suspension Systems

In one embodiment, the suspension system is a tertiary suspension system having water, a first suspension agent, and a second suspension agent. In one embodiment, the first suspension agent and second suspension agent are both soluble in water. In one embodiment, the first suspension agent is soluble in water and the second suspension agent is not soluble in water but for the presence of the first organic solvent.

In one embodiment, the ratio of first suspension agent to second suspension agent is from about 6:4 to about 2:8. In one embodiment, the ratio of first suspension agent to second suspension agent is from about 6 to about 4. In one embodiment, the ratio of first suspension agent to second suspension agent is from about 5 to about 5. In one embodiment, the ratio of first suspension agent to second suspension agent is from about 4 to about 6. In one embodiment, the ratio of first suspension agent to second suspension agent is from about 3 to about 7. In one embodiment, the ratio of first suspension agent to second suspension agent is from about 2 to about 8.

In one embodiment, the ratio of water to first and second suspension agents is from about 6:4 to about 2:8. In one embodiment, the ratio of water to first and second suspension agents is from about 6 to about 4. In one embodiment, the ratio of water to first and second suspension agents is from about 5 to about 5. In one embodiment, the ratio of water to first and second suspension agents is from about 4 to about 6. In one embodiment, the ratio of water to first and second suspension agents is from about 3 to about 7. In one embodiment, the ratio of water to first and second suspension agents is from about 2 to about 8.

In one embodiment, the first and second suspension agents are independently selected from the group consisting of an organic solvent, a water-soluble polymer, and a salt. In one embodiment, the water-soluble polymer is selected from the group consisting of polyethylene glycol, polyacrylic acid, polyethyleneimine, polyvinyl alcohol, polyacrylamides, carboxyvinyl polymers, poly(vinylpyrrolidinone) (PVP) and copolymers, and polyoxypropylene In one embodiment, the water-soluble polymer is polyethylene glycol (PEG). Different molecular weights of polyethylene glycol may be utilized including, but not limited to, a range of about 200 MW to about 10,000 MW. In some embodiments, the water-soluble polymer is selected from the group consisting of PEG 200 MW, PEG 400 MW, PEG 500 MW, PEG 1,000 MW, PEG 2,000 MW, PEG 5,000 MW, and PEG 10,000 MW. In some embodiments, the water-soluble polymer is selected from the group consisting of PEG 200 MW, PEG 400 MW, PEG 500 MW, and PEG 1,000 MW. In one embodiment, the water-soluble polymer is PEG 200 MW. In one embodiment, the water-soluble polymer is PEG 400 MW. In one embodiment, the water-soluble polymer is PEG 500 MW. In one embodiment, the water-soluble polymer is PEG 1,000 MW. In one embodiment, the water-soluble polymer is 2,000 MW. In one embodiment, the water-soluble polymer is PEG 5,000 MW. In one embodiment, the water-soluble polymer is PEG 10,000 MW.

In one embodiment, the salt is a metallic salt. In one embodiment, the salt is a metallic salt comprising a cation and an anion. In one embodiment, the cation of the metallic salt is selected from the group consisting of aluminum, sodium, potassium, calcium, copper, iron, magnesium, potassium, and calcium. In one embodiment, the cation is ammonium.

In one embodiment, the organic solvent is selected from the group consisting of diethylene glycol n-butyl ether, dipropylene glycol n-propyl ether, hexylene glycol, ethylene glycol, dipropylene glycol, tripropylene glycol, dipropylene glycol monobutyl ether, dipropylene glycol monomethyl ether, ethylene glycol monobutyl ether, tripropylene glycol methyl ether, dipropylene glycol monopropyl ether, propylene glycol, glycerol, and other glycols or glycol ethers. In one embodiment, the organic solvent is selected from the group consisting of glycols and glycol ethers. In one embodiment, the organic solvent is a glycol. In one embodiment, the organic solvent is a glycol ether. In one embodiment, the suspension agent has a flashpoint below a certain threshold.

Soluble Polysaccharides

In one embodiment, the soluble polysaccharide includes one or more polysaccharides that are soluble in a suspension system. In one embodiment, the firefighting extinguishing composition may include a dissolved component and an un-dissolved component. In one embodiment, the firefighting extinguishing composition may include a hydrated xanthan component and an un-hydrated konjac component.

In one embodiment, the one or more soluble polysaccharide is selected from the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, xanthan gum, acacia gum, cassia gum, diutan gum, fenugreek gum, ghatti gum, hydroxyethylcellulose, hydroxypropylmethylcellulose, karaya gum, konj ac gum, pectin, propylene glycol alginate, and other natural gums and their derivatives. In one embodiment, the soluble polysaccharide is a natural gum or a natural gum derivative. In some embodiments comprising more than one soluble polysaccharide, those polysaccharides may be selected from a mixture of the foregoing list of polysaccharides.

In one embodiment, the one or more soluble polysaccharide is selected from the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, and xanthan gum, acacia gum, cassia gum, diutan gum, fenugreek gum, ghatti gum, hydroxyethylcellulose, hydroxypropylmethylcellulose, karaya gum, konj ac gum, pectin, propylene glycol alginate. In some embodiments comprising more than one soluble polysaccharide, those polysaccharides may be selected from a mixture of the foregoing list of polysaccharides.

Representative amounts of the soluble polysaccharide range from about 0.1 wt. % to about 5.0 wt. % of the firefighting extinguishing composition. In one embodiment, the amount of the soluble polysaccharide is in the range of about 0.1 wt. % to about 5.0 wt. % of the firefighting extinguishing composition. In one embodiment, the amount of the soluble polysaccharide is in the range of about 0.1 wt. % to about 1.0 wt. % of the firefighting extinguishing composition. In one embodiment, the amount of the soluble polysaccharide is in the range of about 0.1 wt. % to about 0.8 wt. % of the firefighting extinguishing composition. In one embodiment, the amount of soluble polysaccharide is in the range of about 0.3 wt. % to about 0.8 wt. % of the firefighting extinguishing composition. In one embodiment, the amount of the soluble polysaccharide is in the range of about 0.2 wt. % to about 0.7 wt. % of the firefighting extinguishing composition. In one embodiment, the amount of the soluble polysaccharide is in the range of about 0.3 wt. % to about 0.4 wt. % of the firefighting extinguishing composition. In some embodiments, the amount of soluble polysaccharide is about 0.1 wt. %, 0.2 wt. %, 0.3 wt. %, 0.4 wt. %, 0.5 wt. %, 0.6 wt. %, 0.7 wt. %, 0.8 wt. %, 0.9 wt. %, 1.0 wt. %, 1.2 wt. %, 1.3 wt. %, 1.4 wt. %, 1.5 wt. %, 1.6 wt. %, 1.7 wt. %, 1.8 wt. %, 1.9 wt. %, 2.0 wt. %, 2.5 wt. %, or 5.0 wt. % of the firefighting extinguishing composition. In one embodiment, the amount of soluble polysaccharide is about 0.5 wt. % of the firefighting extinguishing composition.

In one embodiment, the soluble polysaccharide is xanthan gum. Xanthan gum is a known polysaccharide secreted by the bacterium Xanthomonas campestris composed of pentasaccharide repeating units, having glucose, mannose, and glucuronic acid in the molar ratio 2.0:2.0: 1.0. It is produced by the fermentation of glucose, sucrose, or lactose. After a fermentation period, the polysaccharide can be precipitated from a growth medium with isopropyl alcohol, dried, and ground into a fine powder, and later added to a liquid medium to form the gum. In one embodiment, the amount of xanthan gum is in the range of about 0.3 wt. % to about 0.8 wt. % of the firefighting extinguishing composition. In one embodiment, the amount of xanthan gum is about 0.3 wt. % of the firefighting extinguishing composition. In one embodiment, the amount of xanthan gum is about 0.4 wt. % of the firefighting extinguishing composition. In one embodiment, the amount of xanthan gum is about 0.5 wt. % of the firefighting extinguishing composition. In one embodiment, the amount of xanthan gum is about 0.6 wt. % of the firefighting extinguishing composition. In one embodiment, the amount of xanthan gum is about 0.7 wt. % of the firefighting extinguishing composition. In one embodiment, the amount of xanthan gum is about 0.8 wt. % of the firefighting extinguishing composition.

Insoluble Polysaccharides

In one embodiment, the insoluble polysaccharide includes one or more polysaccharides that are insoluble in a suspension system but that are soluble in water alone. In one embodiment, the insoluble polysaccharide includes one or more polysaccharides that are partially insoluble in a suspension system having water and at least one organic solvent but that are soluble in water alone. In one embodiment, the firefighting extinguishing composition may include a hydrated component and an un-hydrated component. In one embodiment, the firefighting extinguishing composition may include a hydrated xanthan component and an un-hydrated konjac component.

In one embodiment, the one or more insoluble polysaccharide is selected the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, xanthan gum, acacia gum, cassia gum, diutan gum, fenugreek gum, ghatti gum, hydroxyethylcellulose, hydroxypropylmethylcellulose, karaya gum, konj ac gum, pectin, propylene glycol alginate, and other natural gums and their derivatives. In one embodiment, the insoluble polysaccharide is a natural gum or a natural gum derivative. In some embodiments comprising more than one insoluble polysaccharide, those polysaccharides may be selected from a mixture of the foregoing list of polysaccharides.

In one embodiment, the one or more insoluble polysaccharide is selected from the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, and xanthan gum, acacia gum, cassia gum, diutan gum, fenugreek gum, ghatti gum, hydroxyethylcellulose, hydroxypropylmethylcellulose, karaya gum, konjac gum, pectin, propylene glycol alginate. In some embodiments comprising more than one insoluble polysaccharide, those polysaccharides may be selected from a mixture of the foregoing list of polysaccharides.

Representative amounts of the insoluble polysaccharide range from about 1 wt. % to about 15 wt. % of the firefighting extinguishing composition. In one embodiment, the amount of the insoluble polysaccharide is in the range of about 1 wt. % to about 15 wt. % of the firefighting extinguishing composition. In one embodiment, the amount of the insoluble polysaccharide is in the range of about 3 wt. % to about 12 wt. % of the firefighting extinguishing composition. In one embodiment, the amount of the insoluble polysaccharide is in the range of about 4 wt. % to about 10 wt. % of the firefighting extinguishing composition. In one embodiment, the amount of the insoluble polysaccharide is in the range of about 6 wt. % to about 7 wt. % of the firefighting extinguishing composition. In some embodiments, the amount of insoluble polysaccharide is about 1 wt. %, 2 wt. %, 3 wt. %, 4 wt. %, 5 wt. %, 6 wt. %, 7 wt. %, 8 wt. %, 9 wt. %, 10 wt. %, 1 1 wt. %, 12 wt. %, 13 wt. %, 14 wt. %, or 15 wt. % of the firefighting extinguishing composition.

In one embodiment, the insoluble polysaccharide is konjac gum. Konjac, also known as konnyaku, gonyak, konjak, konjaku, konnyaku potato, devil's tongue, voodoo lily, snake palm, or elephant yam, is a perennial plant of the genus Amorphophallus found in tropical eastern Asia. The dried corm of the konjac plant contains about 40% glucomannan gum. In one embodiment, the amount of konjac gum is in the range of about 4 wt. % to about 10 wt. % of the firefighting extinguishing composition. In one embodiment, the amount of konjac gum is about 4 wt. % of the firefighting extinguishing composition. In one embodiment, the amount of konjac gum is about 5 wt. % of the firefighting extinguishing composition. In one embodiment, the amount of konjac gum is about 6 wt. % of the firefighting extinguishing composition. In one embodiment, the amount of konjac gum is about 7 wt. % of the firefighting extinguishing composition. In one embodiment, the amount of konjac gum is about 8 wt. % of the firefighting extinguishing composition. In one embodiment, the amount of konjac gum is about 9 wt. % of the firefighting extinguishing composition. In one embodiment, the amount of konjac gum is about 10 wt. % of the firefighting extinguishing composition.

Combinations of the Soluble and Insoluble Polysaccharides

In one embodiment, the soluble polysaccharide is xanthan gum and the insoluble polysaccharide is konjac gum. Xanthan gum requires less water in order to hydrate than konjac gum.

In one embodiment, the firefighting extinguishing composition includes a ratio of water to 200 MW polyethylene glycol from about 6:4 to about 2:8. In one embodiment, a firefighting extinguishing composition includes a ratio of about 6 to about 4 water to 200 MW polyethylene glycol, with mixtures of about 0.5 wt. % xanthan gum and about 4-10 wt. % konjac gum. In one embodiment, a firefighting extinguishing composition includes a ratio of about 5 to about 5 water to 200 MW polyethylene glycol, with mixtures of about 0.5 wt. % xanthan gum and about 4-10 wt. % konjac gum. In one embodiment, a firefighting extinguishing composition includes a ratio of about 4 to about 6 water to 200 MW polyethylene glycol, with mixtures of about 0.5 wt. % xanthan gum and about 4-10 wt. % konjac gum. In one embodiment, a firefighting extinguishing composition includes a ratio of about 3 to about 7 water to 200 MW polyethylene glycol, with mixtures of about 0.5 wt. % xanthan gum and about 4-10 wt. % konjac gum. In one embodiment, a firefighting extinguishing composition includes a ratio of about 2 to about 8 water to 200 MW polyethylene glycol, with mixtures of about 0.5 wt. % xanthan gum and about 4-10 wt. % konjac gum. These compositions creates stable suspensions.

In one embodiment, a firefighting extinguishing composition includes a ratio of about 6 to about 4 water to 200 MW polyethylene glycol, with mixtures of about 0.5 wt. % xanthan gum and about 4-10 wt. % konjac gum. In one embodiment, a firefighting extinguishing composition includes a ratio of about 6 to about 4 water to 400 MW polyethylene glycol, with mixtures of about 0.5 wt. % xanthan gum and about 4-10 wt. % konjac gum. In one embodiment, a firefighting extinguishing composition includes a ratio of about 6 to about 4 water to 600 MW polyethylene glycol, with mixtures of about 0.5 wt. % xanthan gum and about 4-10 wt. % konjac gum. In one embodiment, a firefighting extinguishing composition includes a ratio of about 6 to about 4 water to 800 MW polyethylene glycol, with mixtures of about 0.5 wt. % xanthan gum and about 4-10 wt. % konjac gum. In one embodiment, a firefighting extinguishing composition includes a ratio of about 6 to about 4 water to 1000 MW polyethylene glycol, with mixtures of about 0.5 wt. % xanthan gum and about 4-10 wt. % konjac gum.

In one embodiment, a firefighting extinguishing composition includes a ratio of about 6 to about 4 water to 200 MW polyethylene glycol, with mixtures of about 0.5 wt. % xanthan gum and about 4 wt. % konjac gum. In one embodiment, a firefighting extinguishing composition includes a ratio of about 6 to about 4 water to 200 MW polyethylene glycol, with mixtures of about 0.5 wt. % xanthan gum and about 5 wt. % konjac gum. In one firefighting extinguishing embodiment, a composition includes a ratio of about 6 to about 4 water to 200 MW polyethylene glycol, with mixtures of about 0.5 wt. % xanthan gum and about 6 wt. % konjac gum. In one firefighting extinguishing embodiment, a composition includes a ratio of about 6 to about 4 water to 200 MW polyethylene glycol, with mixtures of about 0.5 wt. % xanthan gum and about 7 wt. % konjac gum. In one embodiment, a firefighting extinguishing composition includes a ratio of about 6 to about 4 water to 200 MW polyethylene glycol, with mixtures of about 0.5 wt. % xanthan gum and about 8 wt. % konjac gum. In one embodiment, a firefighting extinguishing composition includes a ratio of about 6 to about 4 water to 200 MW polyethylene glycol, with mixtures of about 0.5 wt. % xanthan gum and about 9 wt. % konjac gum. In one embodiment, a firefighting extinguishing composition includes a ratio of about 6 to about 4 water to 200 MW polyethylene glycol, with mixtures of about 0.5 wt. % xanthan gum and about 10 wt. % konjac gum.

In one embodiment, a firefighting extinguishing composition includes a ratio of about 6 to about 4 water to 200 MW polyethylene glycol, with mixtures of about 0.4 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.4 wt. % xanthan gum and about 5 wt. % konjac gum. In one embodiment, a firefighting extinguishing composition includes a ratio of about 6 to about 4 water to 200 MW polyethylene glycol, with mixtures of about 0.4 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.4 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.4 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.4 wt. % xanthan gum and about 4 wt. % to about 10 wt. % konjac gum.

In one embodiment, a firefighting extinguishing composition includes a ratio of about 6 to about 4 water to 200 MW polyethylene glycol, with mixtures of about 0.3 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.3 wt. % xanthan gum and about 5 wt. % konjac gum. In one embodiment, a firefighting extinguishing composition includes a ratio of about 6 to about 4 water to 200 MW polyethylene glycol, with mixtures of about 0.3 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.3 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.3 wt. % xanthan gum and about 4 wt. % to about 10 wt. % konjac gum. In one embodiment, a firefighting extinguishing composition includes a ratio of about 6 to about 4 water to 200 MW polyethylene glycol, with mixtures of about 0.3 wt. % xanthan gum and about 4 wt. % to about 10 wt. % konjac gum.

A Third Polysaccharide

The firefighting extinguishing composition may also include a third polysaccharide. In one embodiment, the third polysaccharide includes one or more polysaccharides that are insoluble in a suspension system having water and one or more suspension agents but that are soluble in water alone. The third polysaccharide may have the same degree of insolubility as the insoluble polysaccharide but a different degree of solubility than that of the soluble polysaccharide that is soluble in the suspension system. Alternatively, the third polysaccharide may have a different degree of solubility than the soluble polysaccharide and the insoluble polysaccharide.

In one embodiment, the third polysaccharide includes polysaccharides that are soluble in the suspension system.

In one embodiment, the third polysaccharide is selected from the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, xanthan gum, acacia gum, cassia gum, diutan gum, fenugreek gum, ghatti gum, hydroxyethylcellulose, hydroxypropylmethylcellulose, karaya gum, konj ac gum, pectin, propylene glycol alginate, and other natural gums and their derivatives. In one embodiment, the third polysaccharide is a natural gum or a natural gum derivative. In some embodiments comprising more than one third polysaccharide, those polysaccharides may be selected from a mixture of the foregoing list of polysaccharides.

In one embodiment, the one or more third polysaccharide is selected from the group consisting of agar, sodium alginate, carrageenan, gum arabic, gum guaicum, neem gum, pistacia lentiscus, gum chatti, caranna, galactomannan, gum tragacanth, karaya gum, guar gum, welan gum, rhamsam gum, locust bean gum, beta-glucan, cellulose, methylcellulose, chicle gum, kino gum, dammar gum, glucomannan, mastic gum, spruce gum, tara gum, psyllium seed husks, gellan gum, and xanthan gum, acacia gum, cassia gum, diutan gum, fenugreek gum, ghatti gum, hydroxyethylcellulose, hydroxypropylmethylcellulose, karaya gum, konj ac gum, pectin, propylene glycol alginate. In some embodiments comprising more than one third polysaccharide, those polysaccharides may be selected from a mixture of the foregoing list of polysaccharides.

Diluting Agent

In one aspect, the firefighting extinguishing composition may also include a diluting agent that dissolves an insoluble polysaccharide that is insoluble in the suspension system of water and one or more suspension agents but is soluble in water alone. In one embodiment, a firefighting extinguishing composition is disclosed that includes a suspension system having water and at least one suspension agent. The firefighting extinguishing composition also includes a soluble polysaccharide that is soluble in the suspension system. The firefighting extinguishing composition also includes a second, insoluble polysaccharide that is insoluble in the suspension system. However, the insoluble polysaccharide is soluble in water alone. The firefighting extinguishing composition also includes at least one diluting agent. The diluting agent dissolves the insoluble polysaccharide that is insoluble in the suspension system of water and one or more suspension agents.

In one embodiment, the diluting agent is water. In one embodiment, the water is selected from the group consisting of fresh water, brackish water, sea water, and combinations thereof. In one embodiment, the diluting agent is a water stream. In one embodiment, the diluting agent is in the range of about 85 wt. % to about 99.5 wt. % of the firefighting extinguishing composition. In one embodiment, the diluting agent is in the range of about 90 wt. % to about 99.5 wt. % of the firefighting extinguishing composition. In one embodiment, the diluting agent is in the range of about 94 wt. % to about 99.5 wt. % of the firefighting extinguishing composition. In one embodiment, the diluting agent is in the range of about 95 wt. % to about 98 wt. % of the firefighting extinguishing composition. In one embodiment, the diluting agent is in the range of about 96 wt. % to about 97 wt. % of the firefighting extinguishing composition. In one embodiment, the diluting agent is 94 wt. % of the firefighting extinguishing composition. In one embodiment, the diluting agent is 95 wt. % of the firefighting extinguishing composition. In one embodiment, the diluting agent is 96 wt. % of the firefighting extinguishing composition. In one embodiment, the diluting agent is 97 wt. % of the firefighting extinguishing composition. In one embodiment, the diluting agent is 98 wt. % of the firefighting extinguishing composition. In one embodiment, the diluting agent is 99 wt. % of the firefighting extinguishing composition.

Shearing and Hydration

As known to one of ordinary skill in the art, shear thinning causes a fluid's viscosity, i.e., the measure of a fluid's resistance to flow, to decrease with an increasing rate of shear stress. A shear thinning fluid may also be referred to as pseudoplastic. All shear thinning compositions are thixotropic as they take a finite time to bring about the rearrangements needed in the microstructural elements that result in shear thinning. In one embodiment, the firefighting extinguishing composition includes a suspension system for shear thinning or pseudoplastic or thixotropic or bingham plastic or viscoplastic fluid.

Hydration, as known to one of ordinary skill, is the process through which a compound, such as a polysaccharide, dissolves. In one embodiment, the soluble polysaccharide may be added to hydrate and dissolve in order to add increased viscosity to the foam concentrate composition. In one embodiment, the insoluble polysaccharide is a finely divided powder, wherein the powder forms a permanent suspension with the viscosity provided by the soluble polysaccharide. This is possible because the viscosity of the suspension is inversely proportional to the amount of shear applied to it. Generally, as the particles are small and have a density close to that of the suspension, they apply almost zero shear to the suspension. With this very low shear, the effective viscosity approaches infinity and prevents the insoluble particles from migrating through the suspension. When proportioned into water to make a foam solution, the insoluble polysaccharide will become soluble and rapidly hydrate, thereby providing viscosity. The compositions function by suspending a polysaccharide in a suspension system it is not soluble in by using viscosity generated by a polysaccharide that is soluble in the suspension system.

In one embodiment, an insoluble polysaccharide is suspended in a suspension system of a soluble polysaccharide, water, and an agent that prevents the insoluble polysaccharide from dissolving consisting of an organic solvent, salt, or polymer. The mixture of the soluble polysaccharide and the insoluble polysaccharide allows the insoluble polysaccharide to utilize the viscosity generated by the soluble polysaccharide to become soluble in the suspension system. It is understood that these compositions include a suspended insoluble polysaccharide within a second soluble polysaccharide, with the blended two polysaccharides placed within a suspension system. As such, the polysaccharide blend has an insoluble polysaccharide which would be insoluble within the suspension system if used by itself, and a soluble polysaccharide which would be soluble in the suspension system if used by itself. The combination of the soluble and insoluble polysaccharides allows the insoluble polysaccharide particles to utilize the viscosity generated by the soluble polysaccharide to inhibit their movement through the solution. Thus, when the particles of insoluble polysaccharide are uniformly dispersed throughout the solution, they form a stable homogenous suspension.

The rate of hydration can influence the effectiveness of the firefighting extinguishing compositions. In one embodiment, the rate of hydration is controlled largely by the particle size of the polysaccharide mixture. Having too slow of a rate of hydration (i.e., having large particles of insoluble polysaccharide) will result in compositions that will have no time to dissolve after they leave the proportioning device.

Foaming Agent

In one aspect, the firefighting extinguishing composition includes a foaming agent. The foaming agent may include traditional firefighting foam chemicals, e.g., surfactants used in current firefighting foams, which give water the ability to foam and may be in the suspension of the insoluble polysaccharide in the suspension system or in a separate solution. In one embodiment, the firefighting extinguishing composition may contain all of the ingredients necessary to create a foam or be separate from the foaming agent. In the former situation, only one solution needs to be incorporated into a water stream to produce the foam needed to secure a hazard. In the latter situation, the concentration of the foaming chemicals can be added to the water stream at a constant concentration while the concentration of the polysaccharide in the final foam can be changed in order to create foams with different properties. One advantage to this would be to extinguish a fire with less polysaccharide and therefore a lower viscosity foam. This foam made with only the traditional firefighting chemicals would be more mobile and extinguish a fire faster than a high viscosity foam. After the fire is extinguished with a low viscosity foam, a combination of foaming agent and polysaccharide suspension could be applied to provide a higher viscosity, longer-lasting vapor suppression foam to protect the hazard until it can be permanently secured. Advantages of incorporating the foaming agent into the firefighting extinguishing composition include increasing the lifetime of the new solution and decreasing the number of times foam would have to be reapplied to the hazard to maintain vapor suppression.

Methods for Making Compositions

In one aspect, a method for making a firefighting extinguishing composition is disclosed. In one embodiment, the method includes the step of mixing water, a suspension agent, a soluble polysaccharide, and an insoluble polysaccharide to form a suspension. The soluble polysaccharide is soluble in the suspension. The insoluble polysaccharide is insoluble or substantially insoluble in the suspension. In one embodiment, the method includes the step of adding the suspension to a water stream to form a diluted solution. The soluble polysaccharide and the insoluble polysaccharide are both soluble in the diluted solution.

In one embodiment, the method includes the step of adding a foaming agent to the water stream. The foaming agent can be added to the water stream prior to adding the suspension to the water stream. Alternatively, the foaming agent can be added to the water stream at the same time as the suspension is added to the water stream.

In one embodiment, a method for making a firefighting extinguishing composition includes the step of adding a soluble polysaccharide and an insoluble polysaccharide to at least one suspension agent. The soluble polysaccharide and insoluble polysaccharide are not soluble in the suspension agent alone. In one embodiment, the method includes the step of adding water to the soluble polysaccharide, insoluble polysaccharide, and the suspension agent. In one embodiment, the method includes the step of mixing water, the suspension agent, the soluble polysaccharide, and the insoluble polysaccharide to form a suspension. The soluble polysaccharide is soluble in the suspension. The insoluble polysaccharide is insoluble or substantially insoluble in the suspension. Mixing is required to uniformly disperse the insoluble polysaccharide throughout the final solution. If not mixed the solution will not be uniform and thus provide inconsistent results.

In one embodiment, the soluble polysaccharide imparts a desired viscosity to the suspension. In one embodiment, the soluble polysaccharide reaches and maintains a desired viscosity of homogeneous dispersion in the suspension. In one embodiment, the insoluble polysaccharide does not increase the desired viscosity of the suspension. In one embodiment, the insoluble polysaccharide does not substantially change the suspension's desired viscosity. In one embodiment, the desired viscosity is obtained using a Brookfield viscometer with spindle LV-4 at 30 RPM. In one embodiment, the firefighting extinguishing compositions have a desired viscosity in the range of about 1000 cPs to about 6000 cPs. In one embodiment, the firefighting extinguishing compositions have a desired viscosity in the range of about 2000 cPs to about 5000 cPs. In one embodiment, the firefighting extinguishing compositions have a desired viscosity in the range of about 3000 cPs to about 4000 cPs. In one embodiment, the firefighting extinguishing compositions have a desired viscosity of about 1000 cPs. In one embodiment, the firefighting extinguishing compositions have a desired viscosity of about 2000 cPs. In one embodiment, the firefighting extinguishing compositions have a desired viscosity of about 3000 cPs. In one embodiment, the firefighting extinguishing compositions have a desired viscosity of about 4000 cPs. In one embodiment, the firefighting extinguishing compositions have a desired viscosity of about 5000 cPs. In one embodiment, the firefighting extinguishing compositions have a desired viscosity of about 6000 cPs.

In one embodiment, the water, first suspension agent, and the second suspension agent are added simultaneously in making the tertiary suspension system. In one embodiment, the first suspension agent is added simultaneously with the second suspension agent. In one embodiment, the water and first suspending solvent are added simultaneously. In one embodiment, the water and the second suspension agent are added simultaneously.

In one embodiment, the soluble polysaccharide is mixed with the insoluble polysaccharide prior to combining with the tertiary suspension system. In one embodiment, the insoluble polysaccharide is blended with the tertiary suspension system prior to the soluble polysaccharide being mixed in the tertiary suspension system. In one embodiment, the soluble polysaccharide is mixed or dissolved in the tertiary suspension system prior to adding the insoluble polysaccharide to the tertiary suspension system.

Additional Ingredients and Applications of the Composition

Other ingredients known to those skilled in the art that are usually employed in firefighting compositions may be employed in the firefighting extinguishing compositions. In one embodiment, additional ingredients may be added to the firefighting extinguishing compositions. In one embodiment, the additional ingredients may be selected from the group consisting of preservatives, buffers to regulate pH (i.e., tris(2-hydroxyethyl)amine, trisodium phosphate, or sodium citrate), corrosion inhibitors (i.e., tolyltriazole, 2-mercaptobenzothiazole or sodium nitrite), antimicrobial agents, multivalent ion salts to lower the critical micelle concentration (i.e. magnesium sulfate), and humectants. In one embodiment, flame retardant materials such as inorganic salts (i.e., phosphates or sulfates) and organic salts (i.e., acetate salts) may be included in the firefighting extinguishing compositions.

The firefighting extinguishing composition can be used in various firefighting applications, including structural fires, packaging fires, material fires, tire fires, coal fires, peat fires, wild fires, bush fires, forest fires, Class B liquid fuel storage tank fires, and other similarly naturally occurring and industrially based fires. Further, the firefighting extinguishing composition may be used to contain or suppress volatile, noxious, explosive, flammable, or otherwise dangerous chemical vapors. The firefighting extinguishing composition can be applied inside a structure, outside a structure, in a ship, or underground. In one embodiment, the firefighting extinguishing compositions are most readily applied to fires directly from their storage/transportation containers using a conventional educator attached to a hose.

In one embodiment of the systems and disclosed compositions, the water-soluble polymer is polyacrylic acid. In one embodiment, the water-soluble polymer is polyethyleneimine. In one embodiment, the water-soluble polymer is polyvinyl alcohol. In one embodiment, the water-soluble polymer is a polyacrylamide. In one embodiment, the water-soluble polymer is a carboxy vinyl polymers. In one embodiment, the water-soluble polymer is poly(vinylpyrrolidinone). In one embodiment, the water-soluble polymer is polyoxypropylene.

In one embodiment where a salt is present, the cation is aluminum. In one embodiment, the cation is sodium. In one embodiment, the cation is potassium. In one embodiment, the cation is calcium. In one embodiment, the cation is copper. In one embodiment, the cation is iron. In one embodiment, the cation is magnesium. In one embodiment, the cation is potassium. In one embodiment, the cation is calcium.

In one embodiment where an organic solvent is present, the organic solvent is diethylene glycol n-butyl ether. In one embodiment, the organic solvent is dipropylene glycol n-propyl ether. In one embodiment, the organic solvent is, hexylene glycol. In one embodiment, the organic solvent is ethylene glycol. In one embodiment, the organic solvent is dipropylene glycol. In one embodiment, the organic solvent is tripropylene glycol. In one embodiment, the organic solvent is dipropylene glycol monobutyl ether. In one embodiment, the organic solvent is dipropylene glycol monomethyl ether. In one embodiment, the organic solvent is ethylene glycol monobutyl ether. In one embodiment, the organic solvent is tripropylene glycol methyl ether. In one embodiment, the organic solvent is dipropylene glycol monopropyl ether. In one embodiment, the organic solvent is propylene glycol. In one embodiment, the organic solvent is glycerol.

In one embodiment having one or more soluble polysaccharide, the one or more polysaccharide is agar. In one embodiment, the soluble polysaccharide is sodium alginate. In one embodiment, the soluble polysaccharide is carrageenan. In one embodiment, the soluble polysaccharide is gum Arabic. In one embodiment, the soluble polysaccharide is gum guaicum. In one embodiment, the soluble polysaccharide is neem gum. In one embodiment, the soluble polysaccharide is pistacia lentiscus. In one embodiment, the soluble polysaccharide is gum chatti. In one embodiment, the soluble polysaccharide is caranna. In one embodiment, the soluble polysaccharide is galactomannan. In one embodiment, the soluble polysaccharide is gum tragacanth. In one embodiment, the soluble polysaccharide is karaya gum. In one embodiment, the soluble polysaccharide is guar gum. In one embodiment, the soluble polysaccharide is welan gum. In one embodiment, the soluble polysaccharide is rhamsam gum. In one embodiment, the soluble polysaccharide is locust bean gum. In one embodiment, the soluble polysaccharide is beta-glucan. In one embodiment, the soluble polysaccharide is cellulose. In one embodiment, the soluble polysaccharide is methylcellulose. In one embodiment, the soluble polysaccharide is chicle gum. In one embodiment, the soluble polysaccharide is kino gum. In one embodiment, the soluble polysaccharide is dammar gum. In one embodiment, the soluble polysaccharide is glucomannan. In one embodiment, the soluble polysaccharide is mastic gum. In one embodiment, the soluble polysaccharide is spruce gum. In one embodiment, the soluble polysaccharide is tara gum. In one embodiment, the soluble polysaccharide is psyllium seed husks. In one embodiment, the soluble polysaccharide is gellan gum. In one embodiment, the soluble polysaccharide is xanthan gum. In one embodiment, the soluble polysaccharide is acacia gum, cassia gum, diutan gum, fenugreek gum, ghatti gum, hydroxyethylcellulose. In one embodiment, the soluble polysaccharide is hydroxypropylmethylcellulose. In one embodiment, the soluble polysaccharide is karaya gum. In one embodiment, the soluble polysaccharide is konjac gum. In one embodiment, the soluble polysaccharide is pectin. In one embodiment, the soluble polysaccharide is propylene glycol alginate.

In one embodiment having one or more insoluble polysaccharides, the insoluble polysaccharide is agar. In one embodiment, the insoluble polysaccharide is sodium alginate. In one embodiment, the insoluble polysaccharide is carrageenan. In one embodiment, the insoluble polysaccharide is gum arabic. In one embodiment, the insoluble polysaccharide is gum guaicum. In one embodiment, the insoluble polysaccharide is neem gum. In one embodiment, the insoluble polysaccharide is pistacia lentiscus. In one embodiment, the insoluble polysaccharide is gum chatti. In one embodiment, the insoluble polysaccharide is caranna. In one embodiment, the insoluble polysaccharide is galactomannan. In one embodiment, the insoluble polysaccharide is gum tragacanth. In one embodiment, the insoluble polysaccharide is karaya gum. In one embodiment, the insoluble polysaccharide is guar gum. In one embodiment, the insoluble polysaccharide is welan gum. In one embodiment, the insoluble polysaccharide is rhamsam gum. In one embodiment, the insoluble polysaccharide is locust bean gum. In one embodiment, the insoluble polysaccharide is beta-glucan. In one embodiment, the insoluble polysaccharide is cellulose. In one embodiment, the insoluble polysaccharide is methylcellulose. In one embodiment, the insoluble polysaccharide is chicle gum. In one embodiment, the insoluble polysaccharide is kino gum. In one embodiment, the insoluble polysaccharide is dammar gum. In one embodiment, the insoluble polysaccharide is glucomannan. In one embodiment, the insoluble polysaccharide is mastic gum. In one embodiment, the insoluble polysaccharide is spruce gum. In one embodiment, the insoluble polysaccharide is tara gum. In one embodiment, the insoluble polysaccharide is psyllium seed husks. In one embodiment, the insoluble polysaccharide is gellan gum. In one embodiment, the insoluble polysaccharide is xanthan gum. In one embodiment, the insoluble polysaccharide is acacia gum. In one embodiment, the insoluble polysaccharide is cassia gum. In one embodiment, the insoluble polysaccharide is diutan gum. In one embodiment, the insoluble polysaccharide is fenugreek gum. In one embodiment, the insoluble polysaccharide is ghatti gum. In one embodiment, the insoluble polysaccharide is hydroxyethylcellulose. In one embodiment, the insoluble polysaccharide is hydroxypropylmethylcellulose. In one embodiment, the insoluble polysaccharide is karaya gum. In one embodiment, the insoluble polysaccharide is konjac gum. In one embodiment, the insoluble polysaccharide is pectin. In one embodiment, the insoluble polysaccharide is propylene glycol alginate.

In one embodiment having a third polysaccharide, the third polysaccharide is agar. In one embodiment, the third polysaccharide is sodium alginate. In one embodiment, the third polysaccharide is carrageenan. In one embodiment, the third polysaccharide is gum Arabic. In one embodiment, the third polysaccharide is gum guaicum. In one embodiment, the third polysaccharide is neem gum. In one embodiment, the third polysaccharide is pistacia lentiscus. In one embodiment, the third polysaccharide is gum chatti. In one embodiment, the third polysaccharide is caranna. In one embodiment, the third polysaccharide is galactomannan. In one embodiment, the third polysaccharide is gum tragacanth. In one embodiment, the third polysaccharide is karaya gum. In one embodiment, the third polysaccharide is guar gum. In one embodiment, the third polysaccharide is welan gum. In one embodiment, the third polysaccharide is rhamsam gum. In one embodiment, the third polysaccharide is locust bean gum. In one embodiment, the third polysaccharide is beta-glucan. In one embodiment, the third polysaccharide is cellulose. In one embodiment, the third polysaccharide is methylcellulose. In one embodiment, the third polysaccharide is chicle gum. In one embodiment, the third polysaccharide is kino gum. In one embodiment, the third polysaccharide is dammar gum. In one embodiment, the third polysaccharide is glucomannan. In one embodiment, the third polysaccharide is mastic gum. In one embodiment, the third polysaccharide is spruce gum. In one embodiment, the third polysaccharide is tara gum. In one embodiment, the third polysaccharide is psyllium seed husks. In one embodiment, the third polysaccharide is gellan gum. In one embodiment, the third polysaccharide is xanthan gum. In one embodiment, the third polysaccharide is acacia gum. In one embodiment, the third polysaccharide is cassia gum. In one embodiment, the third polysaccharide is diutan gum. In one embodiment, the third polysaccharide is fenugreek gum. In one embodiment, the third polysaccharide is ghatti gum. In one embodiment, the third polysaccharide is hydroxyethylcellulose. In one embodiment, the third polysaccharide is hydroxypropylmethylcellulose. In one embodiment, the third polysaccharide is karaya gum. In one embodiment, the third polysaccharide is konjac gum. In one embodiment, the third polysaccharide is pectin. In one embodiment, the third polysaccharide is propylene glycol alginate.

EXAMPLES

Other uses, embodiments and advantages of the firefighting extinguishing compositions are further illustrated by the following examples, but the particular materials and amounts cited in these examples, as well as other conditions and details, should not be construed to unduly limit the firefighting extinguishing compositions.

Example 1

37.8 kilograms of 200 molecular weight polyethylene glycol (PEG) was placed into a 120 liter vessel. 0.5 kilograms of "CP Kelcol KELTROL® BT Xanthan Gum" xanthan gum and 5 kilograms of "Ticagel® Konjac High Viscosity Konjac Gum" konjac gum was then added to the PEG and the vessel and placed under agitation with an axial flow impeller. When the polysaccharides were fully dispersed throughout the PEG, 56.47 kilograms of water was then added to the vessel. This combination was agitated form approximately five (5) hours until the xanthan gum was fully dissolved. At this, point the material was placed into pails for storage until testing.

Later, Example 1 was then proportioned into a water stream containing 1% "Thunderstorm® AR-AFFF 1% or 3% FC-601 A" using an "Ansul model PL-60" line proportioner. This solution was then intern discharged from an "Ansul model HL-60" low expansion hand line nozzle. The samples of the foam were collected and the expansion ratio and drain time were determined in accordance with NFPA standard 412. The % drain time versus expansion ratio for Example 1 is shown in Table 1.

TABLE 1

| % FC-601A | % Example 1 | Expansion Ratio | 25% Drain time |
|---|---|---|---|
| 1 | 0.0 | 7.36 | 440 sec |
| 1 | 1.6 | 7.19 | 1680 sec |
| 1 | 3.2 | 6.85 | 12000 sec |

Example 2

37.8 kilograms of 200 molecular weight polyethylene glycol (PEG) was placed into a 120 liter vessel. 0.6 kilograms of "CP Kelcol KELTROL® BT Xanthan Gum" xanthan gum and 5 kilograms of "TIC Pretested® Tara Gum 100" tara gum was then added to the PEG and the vessel and placed under agitation with an axial flow impeller. When the polysaccharides were fully dispersed throughout the PEG, 56.6 kilograms of water was then added to the vessel. This combination was agitated until the xanthan gum was fully dissolved (~5 hours). At this point, the material was placed into pails for storage until testing.

Later, Example 2 was then proportioned into a water stream containing 1% "Thunderstorm® AR-AFFF 1% or 3% FC-601A" using an "Ansul model PL-60" line proportioner. This solution was then intern discharged from an "Ansul model HL-60" low expansion hand line nozzle. The samples of the foam were collected and the expansion ratio and drain time were determined in accordance with NFPA standard 412. The % drain time versus expansion ratio for Example 2 is shown in Table 2.

TABLE 2

| % FC-601A | % Example 2 | Expansion Ratio | 25% Drain time |
|---|---|---|---|
| 1 | 0.0 | 7.36 | 440 sec |
| 1 | 1.6 | 5.31 | 2340 sec |
| 1 | 3.0 | 4.68 | 3060 sec |

Example 3

37.8 kilograms of 200 molecular weight polyethylene glycol (PEG) was placed into a 120 liter vessel. 0.6 kilograms of "CP Kelcol KELTROL® BT Xanthan Gum" xanthan gum and 5 kilograms of "TICACEL® LV Powder" methylcellulose was then added to the PEG and the vessel and placed under agitation with an axial flow impeller. When the polysaccharides were fully dispersed throughout the PEG, 56.6 kilograms of water was then added to the vessel. This combination was agitated until the xanthan gum was fully dissolved (~5 hours). At this point, the material was placed into pails for storage until testing.

Later, Example 3 was then proportioned into a water stream containing 1% "Thunderstorm® AR-AFFF 1% or 3% FC-601A" using an "Ansul model PL-60" line proportioner. This solution was then intern discharged from an "Ansul model HL-60" low expansion hand line nozzle. The samples of the foam were collected and the expansion ratio and drain time were determined in accordance with NFPA standard 412. The % drain time versus expansion ratio for Example 3 is shown in Table 3. FIG. 1 is a graph illustrating changes in drain time (minutes) with varying % foam additive when utilizing 1% FC-601A with Example 3.

TABLE 3

| % FC-601A | % Example 3 | Expansion Ratio | 25% Drain time |
|---|---|---|---|
| 1 | 0.0 | 7.36 | 440 sec |
| 1 | 1.8 | 7.07 | 1050 sec |
| 1 | 3.3 | 7.20 | 1800 sec |

Example 4

37.8 kilograms of 200 molecular weight polyethylene glycol (PEG) was placed into a 120 liter vessel. 0.6 kilograms of "CP Kelcol KELTROL® BT Xanthan Gum" xanthan gum and 5 kilograms of "TIC Pretested® Guar Gum 8/26 Powder" guar gum was then added to the PEG and the vessel and placed under agitation with an axial flow impeller. When the polysaccharides were fully dispersed throughout the PEG, 56.6 kilograms of water was then added to the vessel. This combination was agitated until the xanthan gum was fully dissolved (~5 hours). At this point, the material was placed into pails for storage until testing.

Figure 2:
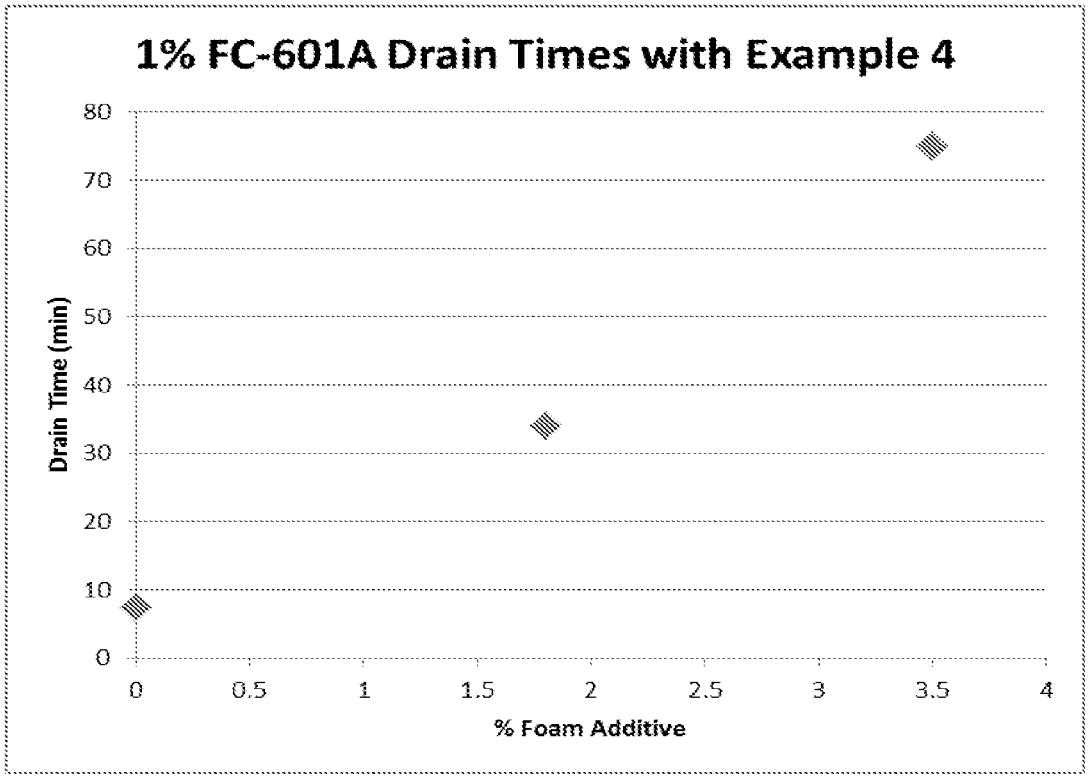
FIG. 2 is a graph illustrating changes in drain time (minutes) with varying % foam additive when utilizing 1% FC-601A with Example 4.

Later, Example 4 was then proportioned into a water stream containing 1% "Thunderstorm® AR-AFFF 1% or 3% FC-601A" using an "Ansul model PL-60" line proportioner. This solution was then intern discharged from an "Ansul model HL-60" low expansion hand line nozzle. The samples of the foam were collected and the expansion ratio and drain time were determined in accordance with NFPA standard 412. The % drain time versus expansion ratio for Example 4 is shown in Table 4. FIG. 2 is a graph illustrating changes in drain time (minutes) with varying % foam additive when utilizing 1% FC-601A with Example 4.

TABLE 4

| % FC-601A | % Example 4 | Expansion Ratio | 25% Drain time |
|---|---|---|---|
| 1 | 0.0 | 7.36 | 440 sec |
| 1 | 1.8 | 6.27 | 2040 sec |
| 1 | 3.5 | 5.42 | 4500 sec |

Example 5

37.8 kilograms of 200 molecular weight polyethylene glycol (PEG) was placed into a 120 liter vessel. 0.6 kilograms of "CP Kelcol KELTROL® BT Xanthan Gum" xanthan gum and 5 kilograms of "TIC Pretested® Pre-Hydrated® Guar Gum 8/24 Powder" guar gum was then added to the PEG and the vessel and placed under agitation with an axial flow impeller. When the polysaccharides were fully dispersed throughout the PEG, 56.6 kilograms of water was then added to the vessel. This combination was agitated until the xanthan gum was fully dissolved (~5 hours). At this point, the material was placed into pails for storage until testing.

Figure 3:
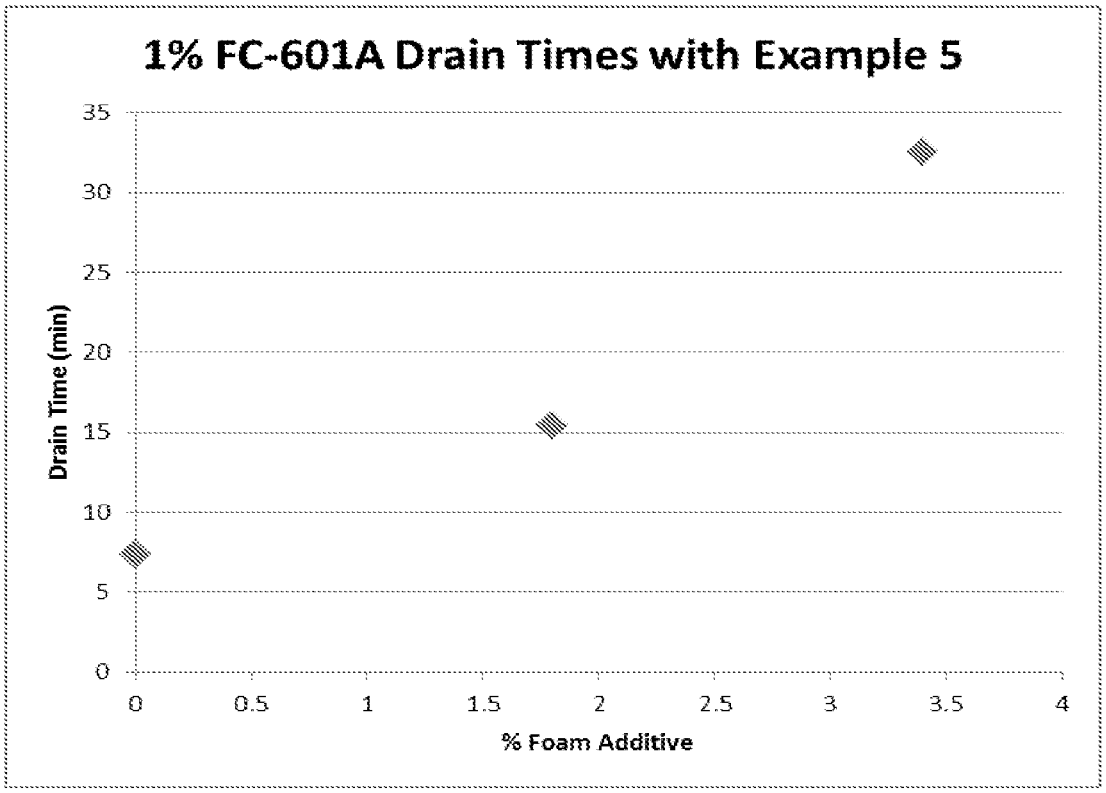
FIG. 3 is a graph illustrating changes in drain time (minutes) with varying % foam additive when utilizing 1% FC-601A with Example 5.

Later, Example 5 was then proportioned into a water stream containing 1% "Thunderstorm® AR-AFFF 1% or 3% FC-601A" using an "Ansul model PL-60" line proportioner. This solution was then intern discharged from an "Ansul model HL-60" low expansion hand line nozzle. The samples of the foam were collected and the expansion ratio and drain time were determined in accordance with NFPA standard 412. The % drain time versus expansion ratio for Example 5 is shown in Table 5. FIG. 3 is a graph illustrating changes in drain time (minutes) with varying % foam additive when utilizing 1% FC-601A with Example 5.

TABLE 5

| % FC-601A | % Example 5 | Expansion Ratio | 25% Drain time |
|---|---|---|---|
| 1 | 0.0 | 7.36 | 440 sec |
| 1 | 1.8 | 6.56 | 924 sec |
| 1 | 3.4 | 5.97 | 1950 sec |

Example 6

36.8 grams of (Methylene glycol monobutyl ether was placed into a 150 mL beaker. 0.5 grams of "CP Kelcol KELTROL® BT Xanthan Gum" xanthan gum and 7.5 grams of "Ticagel® Konjac High Viscosity Konjac Gum" konjac gum was then added to the diethylene glycol monobutyl ether and the beaker and placed under agitation on a standard magnetic stir plate. When the polysaccharides were fully dispersed throughout the polyethylene glycol, 56.7 grams of water was then added to the beaker. This combination was agitated until the xanthan gum was fully dissolved (~5 hours).

Figure 4:
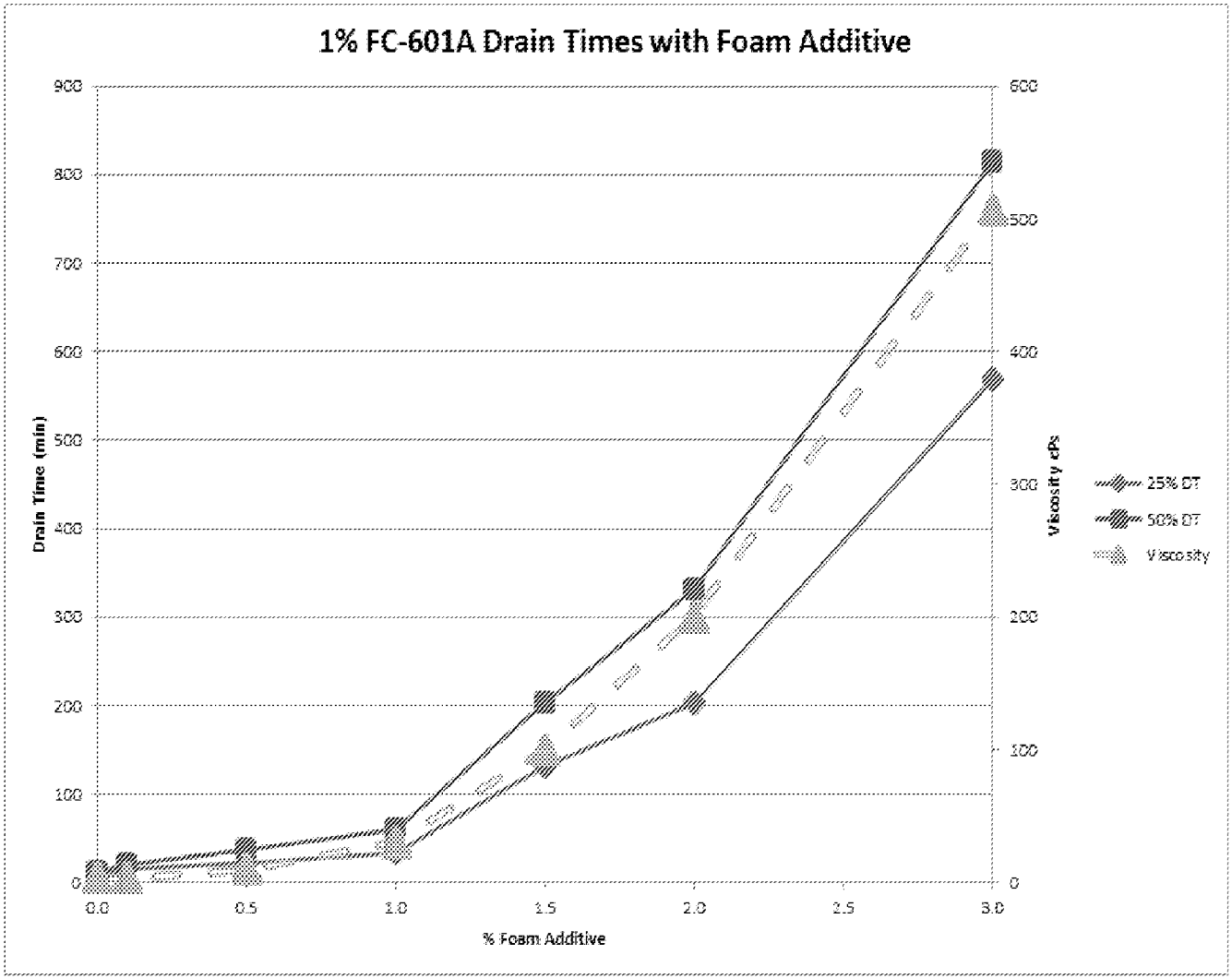
FIG. 4 is a graph illustrating changes in drain time (minutes) with varying % foam additive versus viscosity (cPs) when utilizing 1% FC-601A with Example 6.

Later, using a 150 mL beaker and stir plate, Example 6 was then in water along with 1% of "Thunderstorm® AR-AFFF 1% or 3% FC-601A".100 mL of this solution was then turned into foam using a Waring laboratory blender on low for 60 seconds. This foam was then immediately transferred to a 1000 mL graduated cylinder and the Expansion ratio, 25% Drain Time, and 50% Drain Time were observed. This viscosity of this solution was also observed using a TA Instruments AR 2000 EX Rheometer with a 600 2° steel cone at 20° C. and a shear rate of 10s"1. The % drain time versus viscosity for Example 6 is shown in Table 6. FIG. 4 is a graph of drain time (minutes) versus % foam additive versus viscosity (cPs) when utilizing 1% FC-601A with Example 6.

TABLE 6

| % FC-601A | % Example 6 | 25% DT (min) | 50% DT (min) | Viscosity (cPs) |
|---|---|---|---|---|
| 1.0 | 0.0 | 7.67 | 12.50 | 3.16 |
| 1.0 | 0.1 | 15.47 | 20.53 | 3.63 |
| 1.0 | 0.5 | 22.85 | 37 | 10.06 |
| 1.0 | 1.0 | 33.51 | 60 | 30.77 |
| 1.0 | 1.5 | 131 | 203 | 100.4 |
| 1.0 | 2.0 | 203 | 332 | 200 |
| 1.0 | 3.0 | 569 | 814 | 506.7 |

Example 7

35.92 kilograms of 200 molecular weight polyethylene glycol (PEG) was placed into a 120 liter vessel. 0.2 kilograms of "CP Kelcol KELTROL® BT Xanthan Gum" xanthan gum and 10 kilograms of "Ticagel® Konjac High Viscosity Konjac Gum" konjac gum was then added to the PEG and the vessel and placed under agitation with an axial flow impeller. When the polysaccharides were fully dispersed throughout the PEG, 53.88 kilograms of water was then added to the vessel. This combination was agitated until the xanthan gum was fully dissolved (~5 hours). At this point, the material was placed into pails for storage until testing.

Example 8

36.88 kilograms of ethylene glycol was placed into a 120 liter vessel. 0.3 kilograms of "CP Kelcol KELTROL® BT Xanthan Gum" xanthan gum and 7.5 kilograms of "Ticagel® Konjac High Viscosity Konjac Gum" konjac gum was then added to the PEG and the vessel and placed under agitation with an axial flow impeller. When the polysaccharides were fully dispersed throughout the PEG, 55.32 kilograms of water was then added to the vessel. This combination was agitated until the xanthan gum was fully dissolved (~5 hours). At this point, the material was placed into pails for storage until testing.

Example 9

36.88 kilograms of propylene glycol was placed into a 120 liter vessel. 0.3 kilograms of "CP Kelcol KELTROL® BT Xanthan Gum" xanthan gum and 7.5 kilograms of "Ticagel® Konjac High Viscosity Konjac Gum" konjac gum was then added to the PEG and the vessel and placed under agitation with an axial flow impeller. When the polysaccharides were fully dispersed throughout the PEG, 55.32 kilograms of water was then added to the vessel. This combination was agitated until the xanthan gum was fully dissolved (~5 hours). At this point, the material was placed into pails for storage until testing.

Example 10

36.8 kilograms of propylene glycol was placed into a 120 liter vessel. 0.5 kilograms of "CP Kelcol KELTROL® BT Xanthan Gum" xanthan gum and 7.5 kilograms of "Ticagel® Konjac High Viscosity Konjac Gum" Konjac Gum was then added to the PEG and the vessel and placed under agitation with an axial flow impeller. When the polysaccharides were fully dispersed throughout the PEG, 55.2 kilograms of water was then added to the vessel. This combination was agitated until the xanthan gum was fully dissolved (~5 hours). At this point, the material was placed into pails for storage until testing.

Although the invention herein has been described in connection with described embodiments thereof, it will be appreciated by those skilled in the art that additions, modifications, substitutions, and deletions not specifically described may be made without departing from the spirit and scope of the invention as defined in the appended claims. It is therefore intended that the foregoing detailed description be regarded as illustrative rather than limiting, and that it be understood that it is the following claims, including all equivalents, that are intended to define the spirit and scope of this invention.

What is claimed is:

1. A firefighting foam preservative composition comprising:

a suspension system comprising water; and a suspension agent; wherein the suspension agent comprises one or more of an organic solvent, a water-soluble polymer, and a salt;

a first polysaccharide that is soluble in the suspension system; and a second polysaccharide that is insoluble in the suspension system but soluble in water alone;

wherein the second polysaccharide is different from the first polysaccharide; and the suspension agent comprises one or more of glycerol, a glycol, a glycol ether and a water-soluble polyethylene glycol.

2. A firefighting extinguishing composition, comprising the firefighting foam preservative composition of claim 1 and diluting agent that dissolves the second polysaccharide.

3. The firefighting extinguishing composition of claim 2, wherein the diluting agent comprises water selected from the group consisting of fresh water, sea water, brackish water, and combinations of two or more thereof.

4. The composition of claim 3, further comprising a foaming agent.

5. The composition of claim 1, wherein the first polysaccharide comprises xanthan gum; and the second polysaccharide comprises one or more of konjac gum, diutan gum, tara gum, guar gum and methylcellulose.

6. The composition of claim 5, wherein the second polysaccharide comprises konjac gum.

7. The composition of claim 1, wherein the composition further comprises one or more additional ingredients selected from the group consisting of preservatives, buffers, corrosion inhibitors, antimicrobial agents and humectants.

8. The composition of claim 1, wherein the composition has a viscosity of no more than about 6000 cPs.

9. The composition of claim 1, wherein the weight ratio of water to suspension agent is about 6:4 to 2:8.

10. The composition of claim 1, wherein the composition comprises about 0.1 to 1 wt. % of the first polysaccharide and about 3 to 12 wt. % of the second polysaccharide; the first polysaccharide comprises xanthan gum; and the second polysaccharide comprises one or more of konjac gum, diutan gum, tara gum, guar gum and methylcellulose.

11. The composition of claim 1, wherein the suspension agent comprises one or more organic solvents selected from the group consisting of diethylene glycol n-butyl ether, dipropylene glycol n-propyl ether, hexylene glycol, methylene glycol monobutyl ether, ethylene glycol, dipropylene glycol, tripropylene glycol, dipropylene glycol monobutyl ether, dipropylene glycol monomethyl ether, ethylene glycol monobutyl ether, tripropylene glycol methyl ether, dipropylene glycol monopropyl ether, propylene glycol and glycerol.

12. The composition of claim 1, wherein the suspension agent comprises a water-soluble polyethylene glycol having a molecular weight in a range of about 200 to about 1,000.

13. The composition of claim 1, wherein the suspension agent comprises one or more of ethylene glycol, propylene glycol, diethylene glycol mono-n-butyl ether and a water-soluble polyethylene glycol.

14. The composition of claim 1, wherein the suspension agent comprises a water-soluble polyethylene glycol; and the suspension system comprises at least about 25 wt. % water and at least about 40 wt. % of the water-soluble polyethylene glycol.

15. The composition of claim 14, wherein the composition comprises about 0.1 to 1 wt. % of the first polysaccharide and about 3 to 12 wt. % of the second polysaccharide; the first polysaccharide comprises xanthan gum; and the second polysaccharide comprises one or more of konjac gum, diutan gum and guar gum.

16. The composition of claim 1, wherein the at least one suspension agent comprises an organic solvent; the organic solvent comprises one or more of ethylene glycol, propylene glycol, diethylene glycol mono-n-butyl ether; and the suspension system comprises at least about 25 wt. % water and at least about 40 wt. % of the organic solvent.

17. The composition of claim 16, wherein the composition comprises about 0.1 to 1 wt. % of the first polysaccharide and about 3 to 12 wt. % of the second polysaccharide; the first polysaccharide comprises xanthan gum; and the second polysaccharide comprises one or more of konjac gum, diutan gum and guar gum.

18. The composition of claim 1, wherein the suspension agent is an organic solvent and/or a water-soluble polymer; and the weight ratio of water to suspension agent is about 1:4 to 3:2.

19. A method of producing a firefighting foam comprising diluting the composition of claim 1 with a diluting agent to form a diluted solution; wherein the diluting agent comprises fresh water, brackish water, sea water, or a combination of two or more thereof; and aerating the diluted solution.

20. A firefighting foam preservative composition comprising:

a suspension system comprising water; and a suspension agent; wherein the suspension agent comprises one or more of a glycol, a glycol ether and a water-soluble polyethylene glycol;

a first polysaccharide that is soluble in the suspension system; and a second polysaccharide that is at least partially insoluble in the suspension system but soluble in water alone;

wherein the second polysaccharide is different from the first polysaccharide.

21. The composition of claim 20, wherein the composition has a viscosity of no more than about 6000 cPs.

22. The composition of claim 20, wherein the composition comprises about 0.1 to 1 wt. % of the first polysaccharide and about 1 to 5 wt. % of the second polysaccharide.

23. The composition of claim 20, wherein the first polysaccharide comprises xanthan gum; and the second polysaccharide comprises one or more of konjac gum, tara gum, methylcellulose, diutan gum and guar gum.

24. The composition of claim 20, wherein the first polysaccharide comprises xanthan gum; and the second polysaccharide comprises one or more of rhamsam gum, welan gum and diutan gum.

25. The composition of claim 20, wherein the suspension agent comprises a glycol ether and/or a water-soluble polyethylene glycol.

26. The composition of claim 20, wherein the suspension agent comprises diethylene glycol monobutyl ether and/or 200 MW polyethylene glycol.

27. The composition of claim 20, further comprising a foaming agent.

28. A method of producing a firefighting foam comprising diluting the composition of claim 27 with a diluting agent to form a diluted solution; wherein the diluting agent comprises fresh water, brackish water, sea water, or a combination of two or more thereof; and aerating the diluted solution.

29. The composition of claim 20, wherein the composition comprises about 0.1 to 1 wt. % of the first polysaccharide, which comprises xanthan gum; and about 1 to 5 wt. % of the second polysaccharide, which comprises diutan gum.

30. The composition of claim 20, wherein the composition comprises about 0.1 to 1 wt. % of the first polysaccharide, which comprises xanthan gum; about 1 to 5 wt. % of the second polysaccharide, which comprises one or more of rhamsam gum, welan gum and diutan gum; and the suspension agent comprises diethylene glycol monobutyl ether.

31. The composition of claim 30, wherein the first polysaccharide comprises xanthan gum; and the second polysaccharide comprises rhamsam gum.

32. The composition of claim 30, wherein the first polysaccharide comprises xanthan gum; and the second polysaccharide comprises welan gum.

33. The composition of claim 30, wherein the first polysaccharide comprises xanthan gum; and the second polysaccharide comprises diutan gum.

34. The composition of claim 30, wherein the composition has a viscosity of no more than about 6000 cPs.

35. The composition of claim 30, further comprising a foaming agent.

36. A method of producing a firefighting foam comprising:

diluting the composition of claim 35 with a diluting agent to form a diluted solution; wherein the diluting agent comprises fresh water, brackish water, sea water, or a combination of two or more thereof; and aerating the diluted solution.

* * * * *